US008545643B2

(12) United States Patent
Pike et al.

(10) Patent No.: US 8,545,643 B2
(45) Date of Patent: Oct. 1, 2013

(54) HIGH TEMPERATURE LOW THERMAL EXPANSION NI-MO-CR ALLOY

(75) Inventors: Lee Pike, Kokomo, IN (US); S. Krishna Srivastava, Kokomo, IN (US)

(73) Assignee: Haynes International, Inc., Kokomo, IN (US)

( * ) Notice: Subject to any disclaimer, the term of this patent is extended or adjusted under 35 U.S.C. 154(b) by 0 days.

(21) Appl. No.: 13/398,996

(22) Filed: Feb. 17, 2012

(65) Prior Publication Data

US 2012/0213660 A1 Aug. 23, 2012

Related U.S. Application Data

(60) Provisional application No. 61/444,240, filed on Feb. 18, 2011.

(51) Int. Cl.
*C22C 19/05* (2006.01)
*C22F 1/10* (2006.01)

(52) U.S. Cl.
USPC ..... 148/427; 420/442; 420/453; 420/443; 148/677

(58) Field of Classification Search
USPC ..... 420/453, 442–443; 148/427, 677
See application file for complete search history.

(56) References Cited

U.S. PATENT DOCUMENTS 4,692,305 A * 9/1987 Rangaswamy et al. ..... 420/436
4,818,486 A 4/1989 Rothman et al.
5,312,697 A 5/1994 Kiser et al.
5,972,289 A 10/1999 Sikka et al.
7,160,400 B2 1/2007 Magoshi et al.

FOREIGN PATENT DOCUMENTS

EP 0223135 A1 5/1987
EP 2196551 A1 6/2010
JP 09157779 6/1997
JP 2008144202 A 6/2008

OTHER PUBLICATIONS

International Search Report and Written Opinion for PCT/US2012/025574 dated May 31, 2012.

* cited by examiner

*Primary Examiner* — Jessee Roe
(74) *Attorney, Agent, or Firm* — Buchanan Ingersoll & Rooney PC

(57) ABSTRACT

An alloy designed for use in gas turbine engines which has high strength and a low coefficient of thermal expansion is disclosed. The alloy may contain in weight percent 7% to 9% chromium, 21% to 24% molybdenum, greater than 5% tungsten, up to 3% iron, with a balance being nickel and impurities. The alloy must further satisfy the following compositional relationship: 31.95<R<33.45, where the R value is defined by the equation:

$$R=2.66Al+0.19Co+0.84Cr-0.16Cu+0.39Fe+0.60Mn+Mo+0.69Nb+2.16Si+0.47Ta+1.36Ti+1.07V+0.40W$$

The alloy has better hardness after being age-hardened at 1400° F. (760° C.) if tungsten is present from greater than 5% up to 10% and a preferred density if the alloy contains greater than 5% up to 7% tungsten.

15 Claims, 3 Drawing Sheets

HIGH TEMPERATURE LOW THERMAL EXPANSION NI-MO-CR ALLOY

CROSS REFERENCE TO RELATED APPLICATIONS

The present application claims the benefit of U.S. Provisional Patent Application No. 61/444,240 filed on Feb. 18, 2011. The entirety of U.S. Provisional Patent Application No. 61/444,240 is incorporated herein by reference.

BACKGROUND OF THE INVENTION

Metals and alloys will undergo an expansion in size when subjected to elevated temperatures. The degree of this expansion is characterized by the material property known as the coefficient of thermal expansion (COTE). The COTE is a function of both material properties (composition, thermal history, etc.) and external variables (most notably the temperature). The COTE of an alloy is a key property considered in the design of components in most types of mechanical systems operating at elevated temperatures.

Low thermal expansion alloys have been employed in gas turbine engines to provide a high level of dimensional control in critical components such as seal and containment rings, cases, and fasteners. In such applications, other important properties can include mechanical strength, containment capabilities, and oxidation resistance. One alloy which possesses such properties is HAYNES® 242® alloy, developed, manufactured, and sold by Haynes International. This is a Ni—Mo—Cr alloy with a nominal composition of Ni-25Mo-8Cr (all compositions in this document are given in wt. % unless otherwise noted). This alloy was covered by U.S. Pat. No. 4,818,486 of Michael F. Rothman and Hani M. Tawancy which was assigned to Haynes International Inc. The 242 alloy is currently employed in numerous gas turbine applications in both the aero and land-based gas turbine industries.

HAYNES 242 alloy is a high strength, low COTE alloy designed for use in gas turbine engines. It is strengthened by an age-hardening heat treatment which results in the formation of long range ordered domains of the $Ni_2$ (Mo, Cr) phase. These domains provide high tensile and creep strength at temperatures up to around 1300° F. (704° C.). The COTE of 242 alloy is low compared to other Ni-base alloys. This can be attributed to the presence of a high molybdenum (Mo) content in the alloy (25 wt. %). Mo is well known to lower the COTE of nickel-base alloys. Another key feature of 242 alloy is the good oxidation resistance. The presence of 8 wt. % Cr provides sufficient oxidation resistance for use without a protective coating being necessary or in applications where some measure of oxidation resistance is desirable in the event of spallation of the protective coating. Yet another key feature of 242 alloy is its excellent fabricability (formability, hot/cold workability, and weldability) with respect to other age-hardenable nickel-base alloys. Ni-base alloys which are age-hardenable by the gamma-prime phase, for example, are well known to be susceptible to fabrication issues, arising from the fast precipitation kinetics of the gamma-prime phase. In contrast, the $Ni_2$ (Mo, Cr) phase responsible for age-hardening in 242 alloy has slow precipitation kinetics and therefore 242 alloy does not suffer from the fabricability problems described above.

However, the maximum use temperature of age-hardened 242 alloy (around 1200 to 1300° F./(649 to 704° C.)) can limit the use of the alloy in certain applications. As designers are pushing the operating temperatures to higher and higher levels, the need for a low COTE alloy capable of operating at higher temperatures is becoming necessary. A low COTE alloy which can maintain its high mechanical strength to temperatures of 1400° F. (760° C.) or more would represent a significant advantage to the gas turbine industry.

SUMMARY OF THE INVENTION

The principal object of this invention is to provide alloys which possess a low coefficient of thermal expansion, good oxidation resistance, and excellent strength up to at least 1400° F. (760° C.). These highly desirable properties have been found in alloys with elemental compositions in certain ranges, and defined by quantitative relationships which could not have been expected from the prior art. The composition of these alloys are nickel base, contain molybdenum from 21 to 24 wt. %, chromium from 7 to 9 wt. %, and greater than 5 wt. % tungsten. Furthermore, the overall composition of these alloys must have an "R value" ranging between 31.95 and 33.45 where the R value is defined by the following relationship (where elemental quantities are in wt. %):

$$R=2.66Al+0.19Co+0.84Cr-0.16Cu+0.39Fe+0.60Mn+Mo+0.69Nb+2.16Si+0.47Ta+1.36Ti+1.07V+0.40W$$

Boron may be present in these alloys in a small, but effective trace content up to 0.015 wt. % to obtain certain benefits known in the art. To enable the removal of oxygen and sulfur during the melting process, these alloys typically contain small quantities of aluminum and manganese (up to about 0.5 and 1 wt. %, respectively), and possibly traces of magnesium, calcium, and rare earth elements (up to about 0.05 wt. %). Furthermore, iron, copper, carbon, and cobalt are likely impurities in such materials, since they may be carried over from other nickel alloys melted in the same furnaces. Iron is the most likely impurity, and levels up to 2 wt. % are tolerated in materials such as B-2 and 242 alloys. In 242 alloy, copper is allowed up to 0.5 wt. %, carbon is allowed up to 0.03 wt. %, and cobalt is allowed up to 1 wt. %. It is anticipated that similar impurity contents can be tolerated in the alloys of this invention. Other elements which could be present include, but are not limited to, niobium, silicon, tantalum, titanium, and vanadium. It is anticipated that the levels of these impurities would not exceed around 0.2% each, and that these levels could be tolerated by alloys of this invention. To ensure excellent fabricability, the gamma-prime forming elements (Al, Ti, Nb, and Ta) must be kept at sufficiently low levels to ensure that the gamma-prime phase does not occur in appreciable quantities.

DESCRIPTION OF THE PREFERRED EMBODIMENTS

Figure 1:
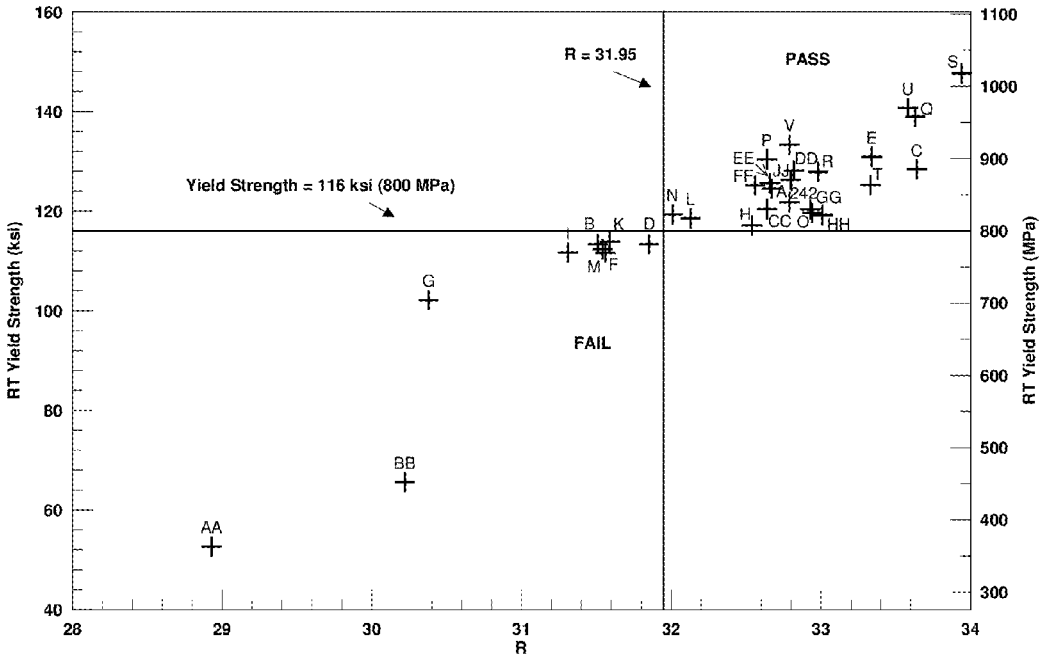
FIG. 1 is a graph in which RT yield strength of several Ni—Mo—Cr and Ni—Mo—Cr—W alloys is plotted against the R value.

We provide Ni—Mo—Cr—W based alloys which typically contain 21 to 24% molybdenum, 7 to 9% chromium, and greater than 5 wt. % tungsten, along with typical impurities and minor element additions, which have a low coefficient of thermal expansion and which have excellent strength and ductility at temperatures ranging from room to temperature to as high as 1400° F. (760° C.). These alloys are also expected to have good oxidation resistance. This combination of properties is a desirable one for many gas turbine applications including, but not limited to, seal and containment rings, cases, and fasteners. We have further found that it is required to maintain the R value within the range of 31.95 to 33.45 where R is defined by the following equation:

$$R=2.66Al+0.19Co+0.84Cr-0.16Cu+0.39Fe+0.60Mn+Mo+0.69\ Nb+2.16Si+0.47Ta+1.36Ti+1.07V+0.40W$$

and the elemental compositions are given in wt. %.

A total of 36 alloys were tested and presented here to describe the invention. Of these, 35 were experimental alloys (labeled A through Y and AA through JJ) and the other was the commercial 242 alloy. The compositions of all 36 alloys are given in Table 1 along with the calculated R value for each composition.

TABLE 1

Composition of Alloys Tested in the Present Study

| Alloy | Cr | Mo | W | Al | B | C | Co | Cu | Fe | Mn | Si | Ni | R value |
|---|---|---|---|---|---|---|---|---|---|---|---|---|---|
| A | 7.88 | 22.24 | 6.27 | 0.18 | 0.003 | 0.004 | 0.07 | 0.02 | 1.08 | 0.34 | 0.08 | Bal. | 32.65 |
| B | 6.82 | 22.04 | 6.21 | 0.17 | 0.003 | 0.003 | 0.07 | 0.02 | 1.08 | 0.34 | 0.07 | Bal. | 31.49 |
| C | 8.86 | 22.35 | 6.28 | 0.18 | 0.003 | <0.002 | 0.07 | 0.02 | 1.07 | 0.34 | 0.10 | Bal. | 33.63 |
| D | 7.66 | 22.16 | 5.12 | 0.15 | 0.003 | 0.002 | 0.07 | 0.02 | 1.05 | 0.34 | 0.08 | Bal. | 31.84 |
| E | 8.32 | 21.91 | 7.96 | 0.16 | 0.003 | 0.003 | 0.07 | 0.02 | 1.07 | 0.33 | 0.09 | Bal. | 33.33 |
| F | 7.74 | 21.29 | 6.24 | 0.18 | 0.003 | 0.004 | 0.09 | 0.02 | 1.07 | 0.31 | 0.08 | Bal. | 31.56 |
| G | 7.86 | 20.10 | 6.14 | 0.18 | 0.002 | 0.003 | 0.09 | 0.02 | 1.06 | 0.31 | 0.06 | Bal. | 30.38 |
| H | 7.95 | 23.02 | 4.15 | 0.18 | 0.003 | 0.002 | 0.08 | 0.02 | 1.01 | 0.32 | 0.05 | Bal. | 32.54 |
| I | 7.49 | 21.47 | 6.16 | 0.14 | 0.002 | 0.004 | 0.06 | 0.02 | 0.99 | 0.32 | 0.06 | Bal. | 31.31 |
| J | 8.01 | 23.01 | 3.09 | 0.13 | 0.002 | 0.002 | 0.06 | 0.04 | 1.14 | 0.36 | 0.02 | Bal. | 32.03 |
| K | 7.95 | 21.34 | 6.31 | 0.13 | 0.002 | <0.002 | 0.06 | 0.03 | 0.98 | 0.30 | 0.06 | Bal. | 31.59 |
| L | 7.91 | 22.01 | 6.11 | 0.13 | 0.002 | 0.003 | 0.06 | 0.03 | 0.95 | 0.30 | 0.06 | Bal. | 32.13 |
| M | 7.88 | 21.59 | 5.70 | 0.14 | 0.002 | 0.002 | 0.05 | 0.02 | 0.98 | 0.30 | 0.05 | Bal. | 31.54 |
| N | 8.00 | 21.61 | 6.54 | 0.14 | 0.002 | 0.002 | 0.07 | 0.03 | 0.96 | 0.30 | 0.06 | Bal. | 32.01 |
| O | 7.92 | 22.60 | 6.16 | 0.17 | 0.002 | 0.002 | 0.06 | 0.02 | 1.08 | 0.35 | 0.06 | Bal. | 32.94 |
| P | 7.88 | 22.29 | 5.89 | 0.16 | 0.004 | 0.003 | 0.06 | n.m. | 1.11 | 0.33 | 0.14 | Bal. | 32.64 |
| Q | 8.15 | 22.51 | 6.07 | 0.38 | 0.003 | 0.003 | 0.06 | 0.02 | 1.08 | 0.38 | 0.08 | Bal. | 33.63 |
| R | 7.81 | 22.71 | 6.01 | 0.21 | 0.002 | 0.002 | 0.09 | 0.02 | 1.05 | 0.32 | 0.06 | Bal. | 32.98 |
| S | 7.92 | 23.36 | 5.96 | 0.30 | 0.003 | 0.002 | 0.06 | 0.02 | 1.07 | 0.31 | 0.06 | Bal. | 33.94 |
| T | 7.90 | 23.21 | 5.47 | 0.22 | 0.002 | <0.002 | 0.06 | 0.02 | 1.05 | 0.31 | 0.05 | Bal. | 33.33 |
| U | 7.84 | 23.04 | 6.37 | 0.25 | 0.002 | 0.002 | 0.07 | 0.02 | 1.08 | 0.30 | 0.06 | Bal. | 33.58 |
| V | 8.10 | 21.08 | 9.82 | 0.11 | 0.002 | 0.002 | 0.05 | n.m. | 1.09 | 0.31 | 0.03 | Bal. | 32.79 |
| W | 7.66 | 23.32 | 2.97 | 0.12 | 0.002 | 0.003 | 0.06 | 0.02 | 1.04 | 0.33 | 0.03 | Bal. | 31.94 |
| X | 7.88 | 24.68 | 6.29 | 0.21 | 0.003 | 0.002 | 0.08 | 0.02 | 1.03 | 0.30 | 0.06 | Bal. | 35.10 |
| Y | 8.00 | 19.61 | 9.84 | 0.12 | 0.002 | 0.001 | 0.05 | n.m. | 1.07 | 0.32 | 0.03 | Bal. | 31.27 |
| 242 | 7.70 | 24.93 | 0.18 | 0.19 | 0.003 | 0.003 | <0.05 | 0.02 | 1.10 | 0.35 | 0.08 | Bal. | 32.78 |
| AA | 9.26 | 19.61 | 2.89 | <0.01 | <0.002 | 0.002 | 0.01 | 0.06 | 1.01 | <0.01 | <0.01 | Bal. | 28.93 |
| BB* | 6.01 | 18.11 | 0.04 | 0.46 | 0.003 | 0.004 | 0.01 | 0.06 | 9.11 | 0.31 | 0.03 | Bal. | 30.22 |
| CC | 7.81 | 22.93 | 5.25 | 0.13 | 0.002 | 0.003 | 0.06 | 0.05 | 1.02 | 0.33 | 0.05 | Bal. | 32.64 |
| DD | 7.04 | 23.59 | 5.68 | 0.13 | 0.002 | 0.002 | 0.06 | 0.04 | 1.02 | 0.32 | 0.05 | Bal. | 32.82 |
| EE | 8.61 | 21.84 | 6.27 | 0.13 | 0.002 | 0.002 | 0.07 | 0.01 | 1.01 | 0.33 | 0.06 | Bal. | 32.66 |
| FF | 7.87 | 22.34 | 6.24 | 0.11 | 0.002 | 0.002 | 2.07 | 0.05 | 1.02 | 0.33 | 0.05 | Bal. | 32.56 |
| GG | 7.73 | 21.96 | 6.20 | 0.12 | 0.002 | 0.005 | 5.17 | 0.03 | 1.02 | 0.32 | 0.05 | Bal. | 32.93 |
| HH | 7.88 | 22.28 | 6.21 | 0.12 | 0.002 | 0.003 | 0.19 | 0.04 | 2.51 | 0.32 | 0.05 | Bal. | 33.01 |
| II | 7.89 | 21.26 | 6.15 | 0.12 | <0.002 | 0.006 | 0.06 | <0.01 | 4.97 | 0.32 | 0.05 | Bal. | 32.92 |
| JJ | 7.88 | 22.54 | 6.30 | 0.14 | 0.002 | 0.002 | 0.06 | 0.01 | 1.01 | 0.33 | 0.07 | Bal. | 32.80 |

n.m. = not measured

*Other elements—Ti: 1.49 wt. %

To produce material for testing, ingots of the experimental alloys were produced by vacuum induction melting followed by electroslag remelting. The ingots were then forged and hot rolled to produce ½" thick plate. One of the alloys (alloy X) badly cracked during the rolling operation and was considered to have too poor fabricability for use as a commercial product. No further testing was done on alloy X and it is not considered an alloy of the present invention. The remaining as-rolled plates were then annealed at temperatures ranging from 1950° F. to 2100° F. (1066 to 1149° C.) to produce a uniform microstructure with an ASTM grain size typically between 3½ and 4½. The commercial 242 alloy was obtained from the manufacturer in the form of ½" plate in the as-annealed condition. The alloys were subjected to several tests to determine their suitability for low-COTE, high strength gas turbine parts for use at temperatures up to 1400° F. (760° C.). This program involved tests to determine the strength and ductility (the combination of which describe a material's containment capability) of the alloys both at room temperature (RT) and 1400° F. (760° C.), the stability/hardening response at 1400° F. (760° C.), and the COTE of the alloys.

As described above, a key property of alloys of this type is the tensile strength at temperatures ranging from room temperature (RT) up to the highest expected service temperature. Of particular interest in this test are two properties: yield strength and ductility (elongation). For gas turbine applications for which the present alloy would be a candidate, a candidate alloy would have high values for both of these two properties. In our experience, gas turbine parts, such as seal and containment rings and cases, made from alloys with a RT yield strength greater than 116 ksi (800 MPa) and a RT elongation greater than 20% should have acceptable containment capability and toughness. The RT tensile properties (including both yield strength and elongation) of several alloys are shown in Table 2. Prior to testing, the samples were given a two-step age-hardening heat treatment of 1400° F. (760° C.)/24 h/furnace cool to 1200° F. (649° C.)/48 h/air cool. Of the 32 alloys tested, 22 alloys were found to have an acceptable RT yield strength of greater than 116 ksi (800 MPa), and 28 were found to have an acceptable RT elongation of 20% or greater. A total of 18 alloys (A, E, H, L, N, O, P, R, T, V, CC, DD, EE, FF, GG, HH, JJ, and 242 alloy) were found to have acceptable values for both RT yield strength and RT elongation.

TABLE 2

| Room Temperature Tensile Properties | | | | | | |
|---|---|---|---|---|---|---|
| Al- | 0.2% Offset Yield Strength | | Ultimate Tensile Strength | | % Elonga- | % Reduction |
| loy | ksi | MPa | ksi | MPa | tion | in Area |
| A | 124.5 | 858 | 196.7 | 1356 | 26.2 | 25.4 |
| B | 113.4 | 782 | 186.1 | 1283 | 39.6 | 47.2 |
| C | 128.4 | 885 | 194.2 | 1339 | 18.6 | 18.4 |
| D | 113.4 | 782 | 184.6 | 1273 | 37.1 | 37.7 |
| E | 130.9 | 903 | 201.0 | 1386 | 29.0 | 27.7 |
| F | 111.6 | 769 | 183.4 | 1265 | 38.5 | 39.8 |
| G | 102.1 | 704 | 173.8 | 1198 | 42.5 | 45.8 |
| H | 117.1 | 807 | 188.3 | 1298 | 38.2 | 41.2 |
| I | 111.6 | 769 | 183.0 | 1262 | 39.0 | 39.4 |
| K | 113.9 | 785 | 185.9 | 1282 | 37.7 | 38.2 |
| L | 118.6 | 818 | 189.9 | 1309 | 34.2 | 33.0 |
| M | 112.4 | 775 | 183.7 | 1267 | 37.6 | 37.9 |
| N | 119.4 | 823 | 190.8 | 1316 | 36.1 | 38.1 |
| O | 119.6 | 825 | 194.7 | 1342 | 30.2 | 32.4 |
| P | 130.4 | 899 | 206.1 | 1421 | 24.7 | 27.0 |
| Q | 139.0 | 958 | 205.8 | 1419 | 15.0 | 15.1 |
| R | 127.9 | 882 | 198.2 | 1367 | 27.4 | 27.0 |
| S | 147.7 | 1018 | 209.2 | 1442 | 14.0 | 15.5 |
| T | 125.2 | 863 | 197.7 | 1363 | 30.2 | 28.3 |
| U | 140.7 | 970 | 203.2 | 1401 | 12.2 | 12.7 |
| V | 133.3 | 919 | 202.7 | 1398 | 26.7 | 27.9 |
| 242 | 121.8 | 840 | 192.6 | 1328 | 36.1 | 49.9 |
| AA | 52.7 | 363 | 119.4 | 823 | 63.9 | 66.0 |
| BB | 65.6 | 452 | 124.9 | 861 | 56.4 | 52.4 |
| CC | 120.4 | 830 | 193.2 | 1332 | 27.6 | 25.6 |
| DD | 128.1 | 883 | 201.7 | 1391 | 30.1 | 31.9 |
| EE | 125.6 | 866 | 197.8 | 1364 | 27.6 | 26.3 |
| FF | 125.2 | 863 | 198.6 | 1369 | 28.8 | 29.8 |
| GG | 120.3 | 829 | 196.0 | 1351 | 30.9 | 32.9 |
| HH | 119.2 | 822 | 186.3 | 1285 | 20.1 | 19.9 |
| II | 110.3 | 761 | 178.4 | 1230 | 20.4 | 19.6 |
| JJ | 126.3 | 871 | 198.6 | 1369 | 26.2 | 26.4 |

It was discovered by the present inventors that the capability of a given alloy to pass the two RT tensile property requirements could be associated with the composition of the alloy using the alloy's "R value" as described by the following equation:

$$R=2.66Al+0.19Co+0.84Cr-0.16Cu+0.39Fe+0.60Mn+Mo+0.69Nb+2.16Si+0.47Ta+1.36Ti+1.07V+0.40W \quad [1]$$

where the elemental compositions are given in wt. %.

In FIG. 1, the RT yield strength of the tested Ni—Mo—Cr and Ni—Mo—Cr—W alloys is plotted against the R value. As shown in FIG. 1, the RT yield strength of the alloys tended to increase with increasing R value. It can be seen that alloys with an R value greater than 31.95 achieve a yield strength greater than the minimum target of 116 ksi (800 MPa). Alloys with an R value greater than 31.95 were found to pass the 116 ksi (800 MPa) minimum, while alloys with an R value less than 31.95 had a RT yield strength which fell below the minimum. The only exception to this was alloy II (not shown in FIG. 1) which had a yield strength of only 110.3 ksi (761 MPa) while having an R value of 32.92. However, this alloy had a very high Fe level of 4.97 wt. %. That level of iron is unacceptable for reasons set forth below. Thus, alloys of the present invention are required to have an R value of greater than 31.95 (while also having an Fe level of 3 wt. % or less).

Figure 2:
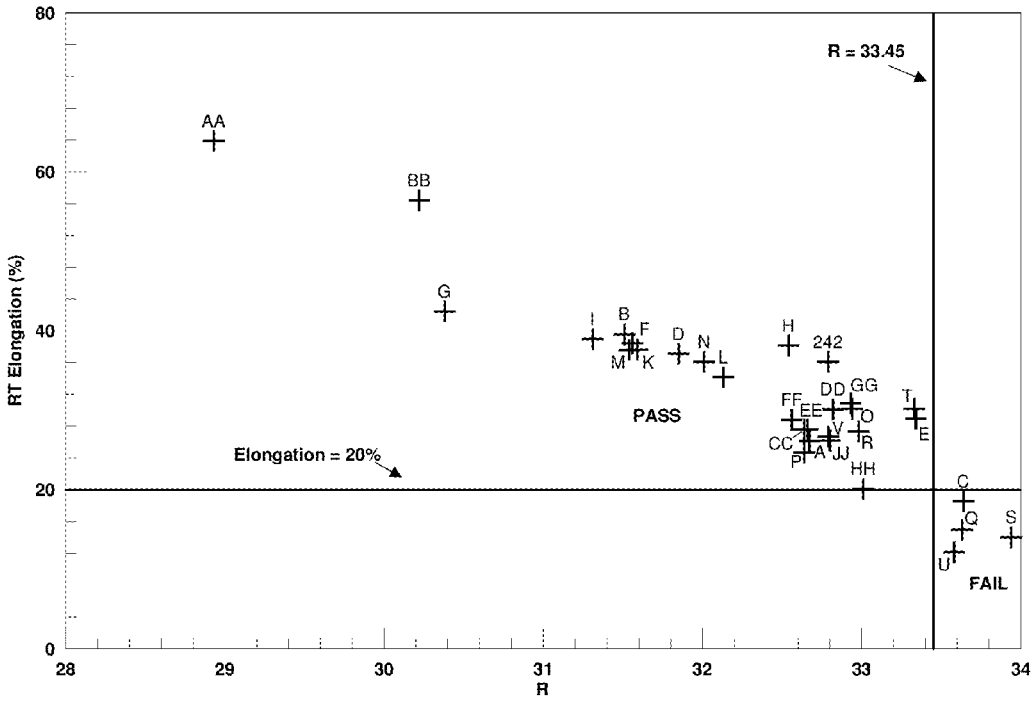
FIG. 2 is a graph in which RT yield strength of the same several Ni—Mo—Cr and Ni—Mo—Cr—W alloys is plotted against the R value.

Conversely, the RT elongation of the tested alloys tended to decrease with increasing R value. As shown in FIG. 2 the RT elongation of these same alloys are plotted against the R value. Alloys with an R value less than 33.45 have RT elongations greater than the minimum target of 20%. Alloys with an R value greater than 33.45 were found to fail the RT tensile elongation requirement of 20% or greater, while alloys with an R value less than 33.45 were found to have acceptable RT tensile elongation. Thus, alloys of the present invention are required to have an R value of less than 33.45. Combining the two requirements, we have the following requirement for alloys of this invention:

$$31.95<R<33.45 \quad [2]$$

For age-hardenable alloys, such as those of the present invention, it is of great importance that the strengthening precipitates responsible for the age-hardening response remain stable across the full range of temperatures to which the alloy would be exposed in service. For alloys which would be suitable for use up to 1400° F. (760° C.) (as demanded for alloys of the present invention), it would therefore be necessary that the strengthening precipitates be stable up to that temperature. In this study, it was determined that a simple method of determining whether the age-hardening response is indeed stable for a given alloy at 1400° F. (760° C.), is to give the alloy (in the annealed condition) a 48-hour heat treatment at 1400° F. (760° C.) and then measuring the RT hardness. Alloys which were observed to increase significantly in hardness after the 1400° F. (760° C.) heat treatment were considered to have sufficient stability at that temperature. In the annealed condition, all of the alloys tested in this study had hardness values below the minimum of the Rockwell C range. That is, they had Rc values less than 20. After the 48-hour heat treatment some of the alloys were found to significantly harden, as shown in Table 3.

TABLE 3

| | Hardness (Rc) | |
|---|---|---|
| Alloy | Before 1400° F. (760° C.) Heat Treatment | After 1400° F. (760° C.) Heat Treatment |
| A | <20 | 29 |
| B | <20 | <20 |
| D | <20 | <20 |
| E | <20 | 32 |
| F | <20 | <20 |
| G | <20 | <20 |
| H | <20 | <20 |
| J | <20 | <20 |
| L | <20 | 25 |
| N | <20 | 23 |
| O | <20 | 33 |
| P | <20 | 32 |
| R | <20 | 32 |
| T | <20 | 32 |
| V | <20 | 37 |
| W | <20 | <20 |
| Y | <20 | <20 |
| 242 | <20 | <20 |
| AA | <20 | <20 |
| BB | <20 | <20 |
| CC | <20 | 32 |
| DD | <20 | 36 |
| EE | <20 | 25 |
| FF | <20 | 23 |
| GG | <20 | 23 |
| HH | <20 | 30 |
| II | <20 | <20 |
| JJ | <20 | 33 |

Figure 3:
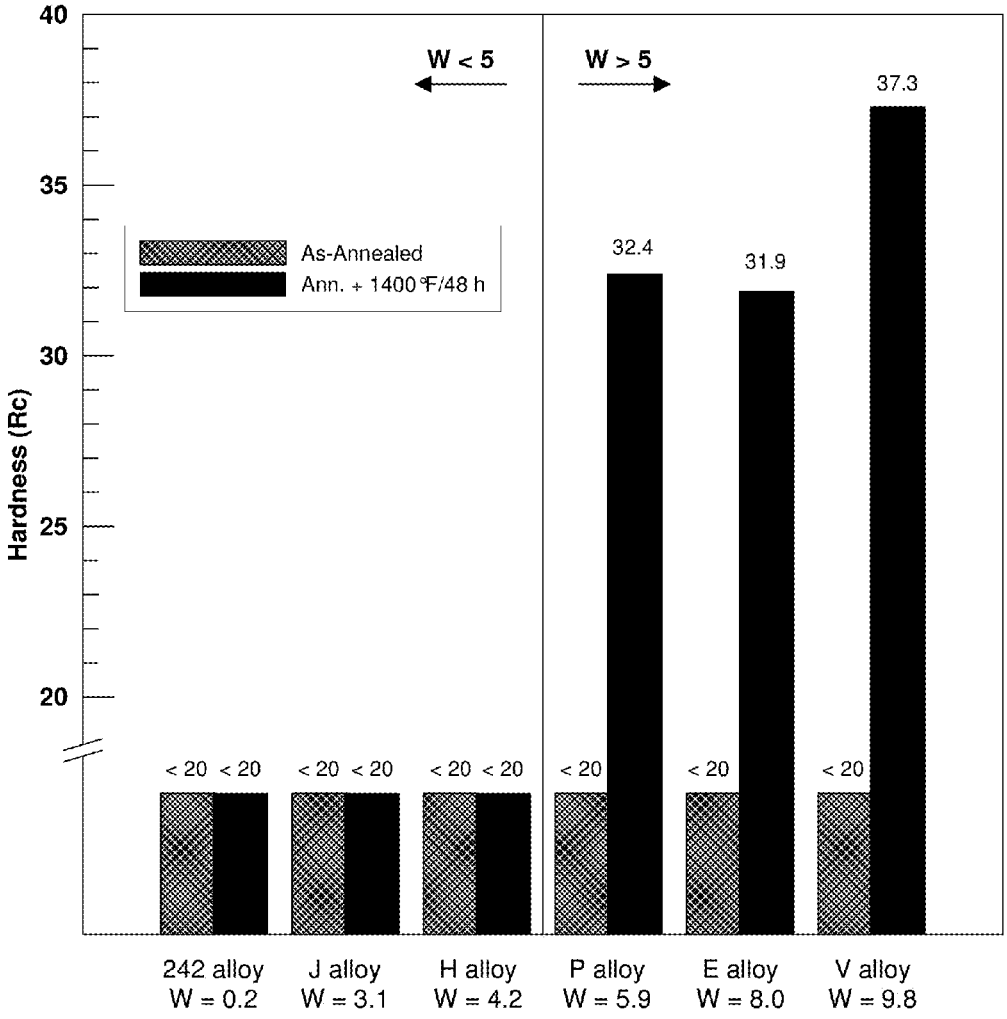
FIG. 3 is a graph which shows the hardness of several alloys both before and after the application of an aging heat treatment at 1400° F. (760° C.).

The most unique and useful aspect of the alloys of the present invention is illustrated in FIG. 3 where the hardness of several alloys is plotted both before and after the application of an aging heat treatment at 1400° F. (760° C.). It is seen in the figure that only alloys with greater than 5 wt. % tungsten were found to undergo hardening as a result of the heat treatment. This age-hardening response is necessary to provide the alloy with high strength at temperatures up to and including the heat treatment temperature of 1400° F. (760° C.). This is a significantly higher use temperature than had been achieved in previously existing alloys of the same general class (characterized by low thermal expansion, high strength, and good oxidation resistance).

This data demonstrates the unexpected result that tungsten is critical to the success of the alloy. Only alloys with greater than 5 wt. % tungsten have the desired age-hardening response following the 1400° F. (760° C.) heat treatment (and thus, the potential for use in the specified gas turbine applications up to 1400° F. (760° C.)). In FIG. 3, the hardness before and after the 48-hour heat treatment at 1400° F. (760° C.) is shown for a number of alloys. Only alloys with greater than 5 wt. % tungsten exhibited a hardening response. Thus, for alloys of the present invention:

$$W>5 \quad [3]$$

where W is the elemental symbol for tungsten, and the elemental content is given in wt. %.

Despite the necessity of having greater than 5 wt. % tungsten, this quality alone was not sufficient to ensure that a given alloy would age-harden at 1400° F. (760° C.). In addition to the presence of greater than 5 wt. % tungsten, it was found that the R value of the alloy must also be greater than the critical 31.95 value derived from the RT tensile properties of the two-step aged samples described previously. This can be seen in Table 4 where the hardness before and after the 48-hour treatment at 1400° F. (760° C.) is shown alongside the R value for a number of alloys (all of which had a tungsten content of greater than 5 wt. %). For alloys with an R value of less than 31.95, the hardness was found to not increase after receiving the 48-hour 1400° F. (760° C.) treatment. On the other hand, alloys with an R value greater than 31.95 were found to increase in hardness to values of 23 Rc or higher. Thus, the criticality of the minimum R value is reinforced. Yet another characteristic was found to be critical to ensure that a given alloy would age-harden at 1400° F. (760° C.). This characteristic was the Fe level. All of the alloys which satisfied both Eqn. [2] and [3] above were found to age-harden at 1400° F. (760° C.), with the notable exception of alloy II. This alloy had 4.97 wt. % Fe—higher than any of the other alloys. The alloy with the highest Fe level which did age-harden at 1400° F. (760° C.) was alloy HH with an Fe content of 2.51 wt. %. These observations were consistent with the previously described fact that alloy HH satisfied the RT tensile yield strength requirement, while alloy II did not. Therefore, alloys of this invention should have an Fe limit of up to only 3 wt. %:

$$Fe\leq 3 \quad [4]$$

It should be noted that the element Fe is not required in the alloys of the present invention, but is normally present in most nickel-base alloys. The presence of Fe allows economic use of revert materials, most of which contain residual amounts of Fe. An acceptable, essentially Fe-free alloy might be possible using new furnace linings and high purity charge materials (with an accompanying significant increase in production cost). Therefore, it is expected the alloys of this invention will normally contain small amounts of Fe which must be carefully controlled to not exceed the level stipulated in Eq. [4].

A closer look at the importance of tungsten is given in Table 5. Here, the hardness before and after the 48-hour heat treatment at 1400° F. (760° C.) is shown along with the tungsten content. For this table, only alloys with an R value in the acceptable range (between 31.95 and 33.45) are included. From the table it is seen that for all alloys with a tungsten content of less than 5 wt. %, no hardening response was observed. However, for all alloys with greater than 5 wt. % tungsten a distinct hardening response was found. Thus, the criticality of the minimum tungsten content is clearly demonstrated.

Another interesting observation in Table 5, is that increasing the tungsten beyond the critical 5 wt. % threshold did not necessarily result in further hardening. For example, alloy T (with an tungsten content of 5.47 wt. %) had a hardness of 32.3 Rc after the 48-hour heat treatment at 1400° F. (760° C.), while alloy E (with a tungsten content of 7.96 wt. %) had a hardness of only 31.9 Rc after the same heat treatment. Of course, both these values had considerably age-hardened relative to their as-annealed hardness value of <20 Rc.

The four alloys in Table 5 with less than 5 wt. % tungsten (H, J, W, and 242 alloy) are not considered part of the present invention as they satisfy Eqn. [2] and Eqn. [4], but not Eqn. [3]. However, the 16 alloys in Table 5 with greater than 5 wt.% tungsten (A, E, L, N, O, P, R, T, V, CC, DD, EE, FF, GG, HH, and JJ alloys) are considered alloys of the present invention as they satisfy Eqns. [2], [3], and [4].

TABLE 4

All alloys have: W > 5 wt. % (& Fe ≤ 3 wt. %)

| | | Hardness (Rc) | |
|---|---|---|---|
| Alloy | R value | Before 1400° F. (760° C.) Heat Treatment | After 1400° F. (760° C.) Heat Treatment |
| G | 30.38 | <20 | <20 |
| Y | 31.27 | <20 | <20 |
| B | 31.51 | <20 | <20 |
| F | 31.56 | <20 | <20 |
| D | 31.85 | <20 | <20 |
| N | 32.01 | <20 | 23 |
| L | 32.13 | <20 | 25 |
| FF | 32.56 | <20 | 23 |
| P | 32.64 | <20 | 32 |
| CC | 32.64 | <20 | 32 |
| EE | 32.66 | <20 | 25 |
| A | 32.67 | <20 | 29 |
| V | 32.79 | <20 | 37 |
| JJ | 32.80 | <20 | 33 |
| DD | 32.82 | <20 | 36 |
| GG | 32.93 | <20 | 23 |
| O | 32.94 | <20 | 33 |
| R | 32.98 | <20 | 32 |
| HH | 33.01 | <20 | 30 |
| T | 33.33 | <20 | 32 |
| E | 33.34 | <20 | 32 |

TABLE 5

All alloys have: 31.95 < R value < 33.45 (& Fe ≤ 3 wt. %)

| | | Hardness (Rc) | |
|---|---|---|---|
| Alloy | Tungsten (wt. %) | Before 1400° F. (760° C.) Heat Treatment | After 1400° F. (760° C.) Heat Treatment |
| 242 | 0.18 | <20 | <20 |
| W | 2.97 | <20 | <20 |
| J | 3.09 | <20 | <20 |
| H | 4.15 | <20 | <20 |
| CC | 5.25 | <20 | 32 |

TABLE 5-continued

All alloys have: 31.95 < R value < 33.45 (& Fe ≤ 3 wt. %)

| Alloy | Tungsten (wt. %) | Hardness (Rc) Before 1400° F. (760° C.) Heat Treatment | Hardness (Rc) After 1400° F. (760° C.) Heat Treatment |
|---|---|---|---|
| T | 5.47 | <20 | 32 |
| DD | 5.68 | <20 | 36 |
| P | 5.89 | <20 | 32 |
| R | 6.01 | <20 | 32 |
| L | 6.11 | <20 | 25 |
| O | 6.16 | <20 | 33 |
| GG | 6.20 | <20 | 23 |
| HH | 6.21 | <20 | 30 |
| FF | 6.24 | <20 | 23 |
| A | 6.27 | <20 | 29 |
| EE | 6.27 | <20 | 25 |
| JJ | 6.30 | <20 | 33 |
| N | 6.54 | <20 | 23 |
| E | 7.96 | <20 | 32 |
| V | 9.82 | <20 | 37 |

As discussed above, alloys of this invention must satisfy Eqns. [2], [3], and [4]. In Eqn. [3] the tungsten is required to be greater than 5 wt. %. That is, no upper limit for tungsten was given in this equation. However, it should be recognized that the further imposition of Eq. [2] would necessarily require certain limits of the various elements (including tungsten) present in these alloys when considered in terms of the overall composition (including, especially, the required elements chromium and molybdenum). Given these restraints there is an effective tungsten upper limit. Considering the 16 example alloys (A, E, L, N, O, P, R, T, V, CC, DD, EE, FF, GG, HH, and, JJ) which are considered part of the present invention, the tungsten levels ranged from greater than 5 up to 10 wt. % (see Table 1). However, this invention is not necessarily limited to 10 wt. % tungsten since it is possible to satisfy both Eqn. [2] and Eqn. [3], at even higher levels of tungsten, while maintaining the required levels of both chromium and molybdenum.

Increasing the amount of tungsten in the alloy increases the density of the alloy causing the same volume of material to weigh more. Because less weight is desired in jet engines, where the present alloy is expected to be used, we prefer to keep tungsten within the range of greater than 5 up to 7% of the alloy.

Another property critical to alloys of this invention is the strength of the alloy at 1400° F. (760° C.) as determined by a tensile test at that temperature. Such testing was performed on five of the experimental alloys. The tests were performed on samples in the same two-step age-hardened condition used to measure the RT tensile properties (described earlier). The compositions of all five alloys satisfied Eq. [2] and Eq. [4]. That is, they all had an R value and an Fe level in the acceptable range. However, two of the alloys (H alloy and 242 alloy) had a tungsten content below 5 wt. % (and thus did not satisfy Eqn. [3]), while three of the alloys (E, P, and V) had greater than 5 wt. % tungsten (thus satisfying Eqn. [3]) and were alloys of the present invention. The results are given in Table 6 along with the tungsten content. It is clear from Table 6 that both H alloy and 242 alloy had a much lower 1400° F. (760° C.) yield strength (around 50 ksi/345 MPa), while that of alloys E, P, and V were much higher, ranging from 73 to 80 ksi (503 to 552 MPa). All five alloys were observed to have excellent ductility (elongation) at this temperature. These findings provide further evidence that the alloys of this invention are very well suited for operation at temperatures up to 1400° F. (760° C.).

TABLE 6

1400° F. (760° C.) Tensile Properties
31.95 < R value < 33.45 (& Fe ≤ 3 wt. %)

| Alloy | Tungsten (wt. %) | 0.2% Offset Yield Strength ksi | 0.2% Offset Yield Strength MPa | Ultimate Tensile Strength ksi | Ultimate Tensile Strength MPa | % Elongation | % Reduction in Area |
|---|---|---|---|---|---|---|---|
| 242 | 0.18 | 50.5 | 348 | 96.1 | 663 | 111.7 | 89.5 |
| H | 4.15 | 49.6 | 342 | 95.2 | 656 | 93.9 | 62.7 |
| P | 5.89 | 73.0 | 503 | 107.0 | 738 | 64.3 | 64.6 |
| E | 7.96 | 76.1 | 525 | 110.9 | 765 | 75.2 | 64.4 |
| V | 9.82 | 80.4 | 554 | 117.4 | 809 | 51.5 | 54.0 |

As mentioned previously, one of the best features of alloys age-hardened by only the $Ni_2(Mo,Cr)$ phase is their excellent fabricability (including formability, hot workability, and weldability). This is a result of the slow precipitation kinetics of the $Ni_2(Mo,Cr)$ phase. This contrasts with alloys containing intentional additions of one or more of the gamma-prime forming elements Al, Ti, Nb, and Ta. The resulting gamma-prime phase, while providing an age-hardening response, has fast precipitation kinetics which lead to reduced fabricability. The alloys of this invention are intentionally kept low in the amount of the gamma-prime forming elements. Specifically, the levels of Al, Ti, Nb, and Ta should be kept below 0.7, 0.5, 0.5, and 0.5 wt. %, respectively. In fact, even lower levels of these elements are more preferred. These levels will be described further later in this specification.

As discussed earlier, another key property of this class of alloys is a low coefficient of thermal expansion (COTE). The COTE of P, V, and 242 alloys are shown in Table 7. Note that P and V alloys are alloys of the present invention, while 242 alloy is not. All three alloys had R values in the acceptable range of 31.95<R<33.45. Among these three alloys, the COTE was found to decrease with decreasing tungsten content. As described in the Background section, the 242 alloy is considered a low COTE alloy. It stands to reason that since the COTE of alloys P and V are even lower than for 242 alloy, that the presence of tungsten in the former two alloys represents an improvement in terms of this critical material property.

The contrast between the commercial 242 alloy and the alloys of this invention is deserving of further discussion. As discussed in the Background section, 242 alloy is a commercial product derived from the invention described in U.S. Pat. No. 4,818,486. The 242 alloy is a Ni-25Mo-8Cr alloy with no intentional tungsten addition. However, the U.S. Pat. No. 4,818,486 describes Mo and W as being "interchangeable" and allows for W levels as high as 30 wt. %. There were no example alloys in U.S. Pat. No. 4,818,486 containing tungsten, and no data provided to support the claim that the elements Mo and W were interchangeable. In contrast, some qualities which tungsten was expected to impart were expected to be less desirable (cost, weight, metal working characteristics) although no evidence was provided to support those expectations, either. In comparison to U.S. Pat. No. 4,818,486, a stark contrast is seen when considering the findings of the present invention. The results reported in this application explicitly show that the elements Mo and W are indeed not interchangeable. In fact, it was clearly demonstrated that the presence of a sufficient amount of tungsten in the Ni—Mo—Cr alloys containing nickel, molybdenum and chromium within the ranges set forth in U.S. Pat. No. 4,818,486 was a necessity to achieve the desired qualities of RT tensile yield strength and elongation, and stability of the age-hardening effect to temperatures as high as 1400° F. (760° C.). Without the tungsten addition, these properties could not be achieved. It was further found that tungsten has the desirable effect of lowering the coefficient of thermal expansion. Neither of these findings could have been expected based on the teachings of U.S. Pat. No. 4,818,486.

TABLE 7

Coefficient of Thermal Expansion
All alloys have: 31.95 < R value < 33.45 (& Fe ≤ 3 wt. %)

| Alloy | Tungsten (wt. %) | Mean CTE, RT to 1200° F. (RT to 649° C.) micro inches/inch-° F. | Mean CTE, RT to 1200° F. (RT to 649° C.) μm/m-° C. | Mean CTE, RT to 1400° F. (RT to 760° C.) micro inches/inch-° F. | Mean CTE, RT to 1400° F. (RT to 760° C.) μm/m-° C. |
|---|---|---|---|---|---|
| 242 | 0.18 | 6.93 | 12.5 | 7.77 | 14.0 |
| P | 5.89 | 6.74 | 12.1 | 7.48 | 13.5 |
| V | 9.82 | 6.58 | 11.8 | 7.24 | 13.0 |

One patent found in the prior art was Magoshi et al. (U.S. Pat. No. 7,160,400). That invention describes alloys which are hardened by both the gamma-prime phase ($Ni_3Al$, $Ni_3(Al, Ti)$, $Ni_3(Al,Ti,Nb,Ta)$) and the $Ni_2(Cr,Mo)$ phase. These alloys are distinct from the alloys of the present invention which intentionally only contain the latter of these two phases. As described previously in this specification, this is because the gamma-prime phase can lead to undesirable properties such as poor formability, workability, and weldability. In the alloys of the present invention the gamma-prime forming elements (Al, Ti, Nb, and Ta) are intentionally kept to low levels to avoid gamma-prime formation. In contrast, the Magoshi et al. patent requires a minimum Al+Ti content of 2.5 at. %, which is higher than allowed in the present invention. Furthermore, the Magoshi et al. patent does not describe the methods of controlling the composition described herein (Eqns. [2], [3], and [4]) which are necessary to reach the desired properties of the present invention. Moreover, the claimed ranges in Magoshi et al. contain compositions which do not meet the requirements of the present invention. Indeed, alloy AA of the present description falls within the Magoshi et al. claims, but does not meet the minimum RT yield strength requirement (Table 2) and does not respond to age-hardening at 1400° F. (760° C.) (Table 3).

Another patent found in the prior art was Kiser et al. (U.S. Pat. No. 5,312,697). That patent describes low thermal expansion alloys for use overlaying on steel substrates. However, the alloys disclosed by Kiser et al. differ significantly from the present invention in that they do not require age-hardenability at 1400° F. (760° C.) (an indicator of high strength for use temperatures as high as 1400° F. (760° C.)). The Mo range in the Kiser et al. patent is 19 to 20 wt. % Mo, well below the 21-24 wt. % required by the present invention. The tungsten levels are also below those of the present invention. Furthermore, there is no teaching in the Kiser et al. patent about controlling the elemental relationships (Eqns. [2], [3], and [4]) to ensure the age-hardening/strength requirements of the present invention. In fact, the compositional ranges described by the Kiser et al. invention cannot be expected to meet the requirements of the present invention, as evidenced by alloy BB described herein in Table 1. This alloy falls in the Kiser et al. range, but not that of the present invention. It was shown in Tables 2 and 3 that alloy BB has neither the required RT tensile strength nor the age-hardenability at 1400° F. (760° C.) required by alloys of the present invention.

For convenience, a table is provided (Table 8) that details which alloys described in this specification are considered part of the present invention, and which are not. Also included in Table 8 is a description of whether each alloy satisfied the R value and tungsten level requirements for the invention as described by Eqn. [2] and Eqn. [3], respectively.

TABLE 8

Alloy Summary

| Alloy | "R value" | Tungsten level | Alloy of this invention |
|---|---|---|---|
| A | OK | OK | YES |
| B | LOW | OK | NO |
| C | HIGH | OK | NO |
| D | LOW | OK | NO |
| E | OK | OK | YES |
| F | LOW | OK | NO |
| G | LOW | OK | NO |
| H | OK | LOW | NO |
| I | LOW | OK | NO |
| J | OK | LOW | NO |
| K | LOW | OK | NO |
| L | OK | OK | YES |
| M | LOW | OK | NO |
| N | OK | OK | YES |
| O | OK | OK | YES |
| P | OK | OK | YES |
| Q | HIGH | OK | NO |
| R | OK | OK | YES |
| S | HIGH | OK | NO |
| T | OK | OK | YES |
| U | HIGH | OK | NO |
| V | OK | OK | YES |
| W | OK | LOW | NO |
| X* | HIGH | OK | NO |
| Y | LOW | OK | NO |
| 242 | OK | LOW | NO |
| AA | LOW | LOW | NO |
| BB | LOW | LOW | NO |
| CC | OK | OK | YES |
| DD | OK | OK | YES |
| EE | OK | OK | YES |
| FF | OK | OK | YES |
| GG | OK | OK | YES |
| HH | OK | OK | YES |
| II | OK | OK | NO** |
| JJ | OK | OK | YES |

*Badly cracked during hot rolling.
**Fe was too high (>3 wt. %)

From the data presented we can expect that the alloy compositions set forth in Table 9 will also have the desired properties.

TABLE 9

Other Alloy Compositions

| Alloy | Cr | Mo | W | Al | B | C | Co | Cu | Fe | Mn | Si | Other | R value |
|---|---|---|---|---|---|---|---|---|---|---|---|---|---|
| 1 | 8 | 22 | 6 | 0.18 | 0.003 | 0.003 | 0.08 | 0.02 | 1 | 0.33 | 0.08 | — | 32.37 |
| 2 | 7 | 22.5 | 6 | 0.18 | 0.003 | 0.003 | 0.08 | 0.02 | 1 | 0.33 | 0.08 | — | 32.03 |
| 3 | 9 | 22 | 6 | 0.18 | 0.003 | 0.003 | 0.08 | 0.02 | 1 | 0.33 | 0.08 | — | 33.21 |
| 4 | 8.5 | 21 | 7 | 0.18 | 0.003 | 0.003 | 0.08 | 0.02 | 1 | 0.33 | 0.08 | — | 32.19 |

TABLE 9-continued

| Other Alloy Compositions | | | | | | | | | | | | | |
|---|---|---|---|---|---|---|---|---|---|---|---|---|---|
| Alloy | Cr | Mo | W | Al | B | C | Co | Cu | Fe | Mn | Si | Other | R value |
| 5 | 7.2 | 24 | 5.2 | 0.18 | 0.003 | 0.003 | 0.08 | 0.02 | 1 | 0.33 | 0.08 | — | 33.38 |
| 6 | 8 | 22 | 5.1 | 0.18 | 0.003 | 0.003 | 0.08 | 0.02 | 1 | 0.25 | 0.08 | — | 31.96 |
| 7 | 8 | 22 | 7 | 0.18 | 0.003 | 0.003 | 0.08 | 0.02 | 1 | 0.33 | 0.08 | — | 32.77 |
| 8 | 8 | 21.5 | 9 | 0.18 | 0.003 | 0.003 | 0.08 | 0.02 | 1 | 0.33 | 0.08 | — | 33.07 |
| 9 | 8 | 21 | 10 | 0.18 | 0.003 | 0.003 | 0.08 | 0.02 | 1 | 0.33 | 0.08 | — | 32.97 |
| 10 | 7 | 21 | 13 | 0.18 | 0.003 | 0.003 | 0.08 | 0.02 | 1 | 0.33 | 0.08 | — | 33.33 |
| 11 | 7 | 21 | 16.4 | — | — | — | — | — | — | — | — | — | 33.44 |
| 12 | 8.5 | 22.5 | 6 | — | — | — | — | — | — | — | — | — | 32.04 |
| 13 | 8 | 22 | 6 | 0.18 | 0.006 | 0.003 | 0.08 | 0.02 | 1 | 0.33 | 0.08 | — | 32.37 |
| 14 | 8 | 22 | 6 | 0.18 | 0.003 | 0.03 | 0.08 | 0.02 | 1 | 0.33 | 0.08 | — | 32.37 |
| 15 | 8 | 22 | 6 | 0.18 | 0.003 | 0.003 | 1 | 0.02 | 0.5 | 0.33 | 0.08 | — | 32.35 |
| 16 | 8 | 22 | 6 | 0.5 | 0.003 | 0.003 | 0.08 | 0.02 | 1 | 0.33 | 0.08 | — | 33.22 |
| 17 | 8 | 22 | 6 | 0.18 | 0.003 | 0.003 | 0.08 | 0.02 | 1 | 0.8 | 0.08 | — | 32.65 |
| 18 | 8 | 22 | 6 | 0.18 | 0.003 | 0.003 | — | — | 1 | 0.33 | — | — | 32.19 |
| 19 | 8 | 22 | 6 | 0.18 | 0.003 | 0.003 | 0.08 | 0.5 | 1 | 0.33 | 0.08 | — | 32.29 |
| 20 | 8 | 22 | 6 | 0.18 | 0.003 | 0.003 | 0.08 | 0.02 | 1 | 0.33 | 0.2 | — | 32.63 |
| 21 | 8 | 22 | 6 | 0.18 | 0.003 | 0.003 | 0.08 | 0.02 | 1 | 0.33 | 0.08 | 0.05 Ca | 32.37 |
| 22 | 8 | 22 | 6 | 0.18 | 0.003 | 0.003 | 0.08 | 0.02 | 1 | 0.33 | 0.08 | 0.05 Mg | 32.37 |
| 23 | 8 | 22 | 6 | 0.18 | 0.003 | 0.003 | 0.08 | 0.02 | 1 | 0.33 | 0.08 | 0.05 Y | 32.37 |
| 24 | 8 | 22 | 6 | 0.18 | 0.003 | 0.003 | 0.08 | 0.02 | 1 | 0.33 | 0.08 | 0.05 Hf | 32.37 |
| 25 | 8 | 22 | 6 | 0.18 | 0.003 | 0.003 | 0.08 | 0.02 | 1 | 0.33 | 0.08 | 0.05 Ce | 32.37 |
| 26 | 8 | 22 | 6 | 0.18 | 0.003 | 0.003 | 0.08 | 0.02 | 1 | 0.33 | 0.08 | 0.05 La | 32.37 |
| 27 | 8 | 22 | 6 | 0.18 | 0.003 | 0.003 | 0.08 | 0.02 | 1 | 0.33 | 0.08 | 0.2 Nb | 32.51 |
| 28 | 8 | 22 | 6 | 0.18 | 0.003 | 0.003 | 0.08 | 0.02 | 1 | 0.33 | 0.08 | 0.2 Ta | 32.47 |
| 29 | 8 | 22 | 6 | 0.18 | 0.003 | 0.003 | 0.08 | 0.02 | 1 | 0.33 | 0.08 | 0.2 Ti | 32.64 |
| 30 | 8 | 22 | 6 | 0.18 | 0.003 | 0.003 | 0.08 | 0.02 | 1 | 0.33 | 0.08 | 0.2 V | 32.59 |

The alloy of the present invention must contain, by weight, 7% to 9% chromium, 21 to 24% molybdenum, greater than 5% tungsten and the balance nickel plus impurities and may contain aluminum, boron, carbon, calcium, cobalt, copper, iron, magnesium, manganese, niobium, silicon, tantalum, titanium, vanadium, and rare earth metals within the ranges set forth in Table 10.

TABLE 10

| Optional Elements in Weight Percent | | | |
|---|---|---|---|
| Element | Broad range | Narrow range | Typical |
| Al | less than 0.7 | up to 0.5 | About 0.2 |
| B | Trace to 0.015 | 0.002-0.006 | About 0.003 |
| C | up to 0.1 | 0.002-0.03 | About 0.003 |
| Ca | up to 0.1 | up to 0.05 | |
| Co | up to 5 | up to 1 | About 0.08 |
| Cu | up to 0.8 | up to 0.5 | About 0.02 |
| Fe | up to 3 | up to 2 | About 1.0 |
| Mg | up to 0.1 | up to 0.05 | |
| Mn | up to 2 | up to 1 | About 0.5 |
| Nb | less than 0.5 | up to 0.2 | |
| Si | up to 0.5 | up to 0.2 | About 0.05 |
| RE* | up to 0.1 | up to 0.05 | |
| Ta | less than 0.5 | up to 0.2 | |
| Ti | less than 0.5 | up to 0.2 | |
| V | up to 0.5 | up to 0.2 | |

*Rare earth metals (RE) may include hafnium, yttrium, cerium, and lanthanum,

While we prefer that cobalt content not exceed 5%, it is likely that higher amounts could be present without sacrifice of the desired properties.

From the compositions of the alloys identified in Table 8 as an alloy of this invention and from the other acceptable alloy compositions in Table 9 we see that an alloy having the desired properties may contain in weight percent 7% to 9% chromium, 21% to 24% molybdenum, greater than 5% tungsten, up to 3% iron, with a balance being nickel and impurities. And the alloy must further satisfy the following compositional relationship:

$$31.95<R<33.45$$

Where the R value is defined by the equation:

$$R=2.66Al+0.19Co+0.84Cr-0.16Cu+0.39Fe+0.60Mn+Mo+0.69Nb+2.16Si+0.47Ta+1.36Ti+1.07V+0.40W$$

The alloy has better hardness after being age-hardened at 1400° F. (760° C.) if tungsten is present from greater than 5% up to 10% as indicated by FIG. 3. Optional elements may be present in amounts set forth in Table 10.

From the specific amounts of the elements in the alloys tested that were considered to be within the invention we see that an alloy having the desired properties may contain in weight percent 7.04% to 8.61% chromium, 21.08% to 23.59% molybdenum. 5.25% to 9.82% tungsten, up to 2.51% iron, with a balance being nickel and impurities. The alloy must further satisfy the following compositional relationship:

$$32.01<R<33.33$$

Where the R value is defined by the equation:

$$R=2.66Al+0.19Co+0.84Cr-0.16Cu+0.39Fe+0.60Mn+Mo+0.69Nb+2.16Si+0.47Ta+1.36Ti+1.07V+0.40W$$

Although we have described certain present preferred embodiments of our alloy it should be distinctly understood that our invention is not limited thereto but may be variously embodied within the following claims;

We claim:

1. A nickel-molybdenum-chromium-tungsten based alloy which becomes harder after a 48-hour heat treatment at 1400° F. and then has a Rockwell C hardness of at least 23, the alloy having a composition comprised in weight percent of:

| | |
|---|---|
| 7 to 9 | chromium |
| 21 to 24 | molybdenum |
| greater than 5 | tungsten |
| up to 3 | iron |
| up to 0.8 | copper |

with a balance of nickel and impurities, the alloy further satisfying the following compositional relationship:

$$31.95<R<33.45$$

where the R value is defined by the equation:

$$R=2.66Al+0.19Co+0.84Cr-0.16Cu+0.39Fe+0.60Mn+Mo+0.69Nb+2.16Si+0.47Ta+1.36Ti+1.07V+0.40W.$$

2. The alloy of claim 1, where tungsten is present from greater than 5 up to 10 wt. %.

3. The alloy of claim 1, where tungsten is present from greater than 5 up to 7 wt. %.

4. The alloy of claim 1, where cobalt is present up to 5 wt. %.

5. The alloy of claim 1, also comprising in weight percent at least one of boron, up to 0.015%, and carbon, up to 0.1%.

6. The alloy of claim 1, also comprising in weight percent aluminum, less than 0.7%.

7. The alloy of claim 1, also comprising in weight percent manganese, up to 2%.

8. The alloy of claim 1, also comprising in weight percent at least one of niobium, less than 0.5%, tantalum, less than 0.5%, and titanium, less than 0.5%.

9. The alloy of claim 1, also comprising in weight percent silicon, up to 0.5%.

10. The alloy of claim 1, also comprising in weight percent vanadium, up to 0.5%.

11. The alloy of claim 1, also comprising at least one element selected from the group consisting of magnesium, calcium, hafnium, yttrium, cerium, and lanthanum, wherein each said element present comprises up to 0.1 weight percent of the alloy.

12. A nickel-molybdenum-chromium-tungsten based alloy which becomes harder after a 48-hour heat treatment at 1400° F. and then has a Rockwell C hardness of at least 23, the alloy consisting essentially of in weight percent:

| | |
|---|---|
| 7 to 9 | chromium |
| 21 to 24 | molybdenum |
| greater than 5 | tungsten |
| less than 0.7 | aluminum |
| present up to 0.015 | boron |
| up to 0.1 | carbon |
| up to 0.1 | calcium |
| up to 5 | cobalt |
| up to 0.8 | copper |
| up to 3 | iron |
| up to 0.1 | magnesium |
| up to 2 | manganese |
| less than 0.5 | niobium |
| up to 1 | silicon |
| less than 0.5 | tantalum |
| less than 0.5 | titanium |
| up to 0.5 | vanadium |
| up to 0.1 | of a rare earth element |

with a balance of nickel and impurities, the alloy further satisfying the following compositional relationship:

$$31.95<R<33.45$$

where the R value is defined by the equation:

$$R=2.66Al+0.19Co+0.84Cr-0.16Cu+0.39Fe+0.60Mn+Mo+0.69Nb+2.16Si+0.47Ta+1.36Ti+1.07V+0.40W.$$

13. A nickel-molybdenum-chromium-tungsten based alloy which becomes harder after a 48-hour heat treatment at 1400° F. and then has a Rockwell C hardness of at least 23, the alloy consisting essentially of in weight percent:

| | |
|---|---|
| 7 to 9 | chromium |
| 21 to 24 | molybdenum |
| greater than 5 | tungsten |
| up to 0.5 | aluminum |
| 0.002 to 0.006 | boron |
| 0.002 to 0.03 | carbon |
| up to 0.05 | calcium |
| up to 1 | cobalt |
| up to 0.5 | copper |
| up to 2 | iron |
| up to 0.05 | magnesium |
| up to 0.8 | manganese |
| up to 0.2 | niobium |
| up to 0.2 | silicon |
| up to 0.2 | tantalum |
| up to 0.2 | titanium |
| up to 0.2 | vanadium |
| up to 0.05 | of a rare earth element |

with a balance of nickel and impurities, the alloy further satisfying the following compositional relationship:

$$31.95<R<33.45$$

where the R value is defined by the equation:

$$R=2.66Al+0.19Co+0.84Cr-0.16Cu+0.39Fe+0.60Mn+Mo+0.69Nb+2.16Si+0.47Ta+1.36Ti+1.07V+0.40W.$$

14. A nickel-molybdenum-chromium-tungsten based alloy which becomes harder after a 48-hour heat treatment at 1400° F. and then has a Rockwell C hardness of at least 23, the alloy consisting essentially of in weight percent:

| | |
|---|---|
| 7.04 to 8.61 | chromium |
| 21.08 to 23.59 | molybdenum |
| 5.25 to 9.82 | tungsten |
| up to 2.51 | iron |
| up to 0.8 | copper |

with a balance of nickel and impurities, the alloy further satisfying the following compositional relationship:

$$32.01<R<33.33$$

where the R value is defined by the equation:

$$R=2.66Al+0.19Co+0.84Cr-0.16Cu+0.39Fe+0.60Mn+Mo+0.69Nb+2.16Si+0.47Ta+1.36Ti+1.07V+0.40W.$$

15. The alloy of claim 14, also containing up to 5.17 wt. % cobalt.

* * * * *